US005110311A

United States Patent [19]

Wilkerson

[11] Patent Number: 5,110,311

[45] Date of Patent: May 5, 1992

[54] AIR BOAT SLIME PLOW AND METHODS OF USE

[76] Inventor: William F. Wilkerson, 100 SW. 4th St., Mulberry, Fla. 33860

[21] Appl. No.: 610,420

[22] Filed: Nov. 7, 1990

[51] Int. Cl.[5] ..... B63B 35/32

[52] U.S. Cl. ..... 440/37; 37/98

[58] Field of Search ..... 172/810, 811, 817, 292; 37/54, 98, 234, 236, 272, 277; D12/305; D15/11; 440/37; 180/7.1, 7.4; 114/40

[56] References Cited

U.S. PATENT DOCUMENTS

| | | | |
|---|---|---|---|
| 1,053,876 | 2/1913 | Riley | 440/37 |
| 3,572,273 | 3/1971 | Wood | 114/40 |
| 3,698,163 | 10/1972 | Kelpin | 440/37 |
| 3,847,105 | 11/1974 | Kelpin | 440/37 |
| 3,929,083 | 12/1975 | Blankenship et al. | 114/40 |
| 4,141,308 | 2/1979 | Gainey | 440/37 |
| 4,724,785 | 2/1988 | Van Hauwaert | 440/37 |
| 4,962,718 | 10/1990 | Gornstein | 440/37 |

FOREIGN PATENT DOCUMENTS

| | | | |
|---|---|---|---|
| 1318105 | 1/1963 | France | 440/37 |

*Primary Examiner*—Joseph F. Peters, Jr.
*Assistant Examiner*—Clifford T. Bartz
*Attorney, Agent, or Firm*—Edward M. Livingston

[57] ABSTRACT

An air-boat (2) is provided with a hollow suspension member (4) through which a plow attachment member (3) is insertable to contain plowshare members (10 and 17) at a front section of the air-boat (2). There can be a plurality of hollow suspension members (4) and a hoist (6-9) with mechanical or motorized operation to adjust height and width positioning of the plowshare members (10 and 17). The plowshare members (10) can be V-shaped moldboard surfaces for forming ditches in mud, slime or marsh-bottom deposits. Optionally, the plowshare members can be blades (17) with either sharp, flat or rounded surfaces for parting water plants to form waterways in bodies of water. Methods are provided for forming drain ditches in slime beds and waterways in lakes with thick water-plant growth.

21 Claims, 3 Drawing Sheets

FIG. 1
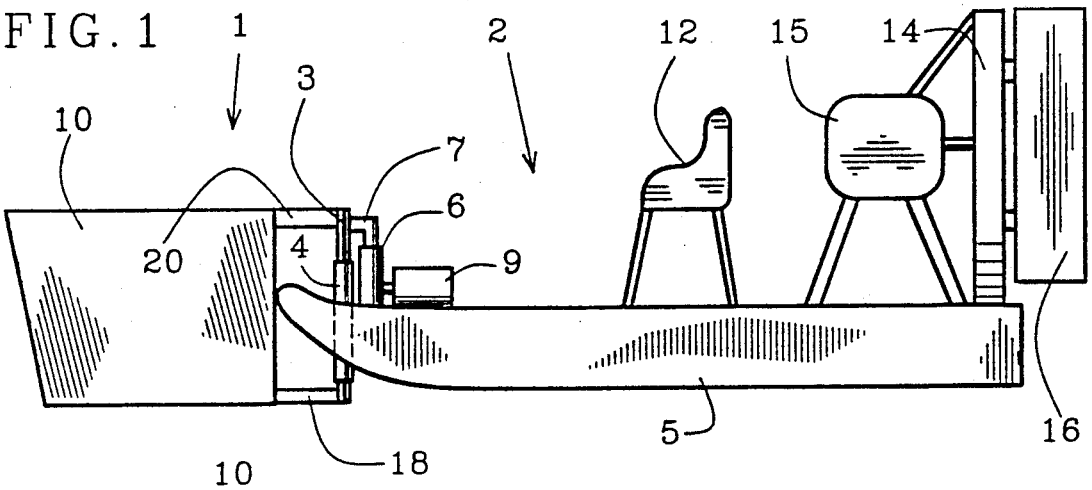
FIG. 2
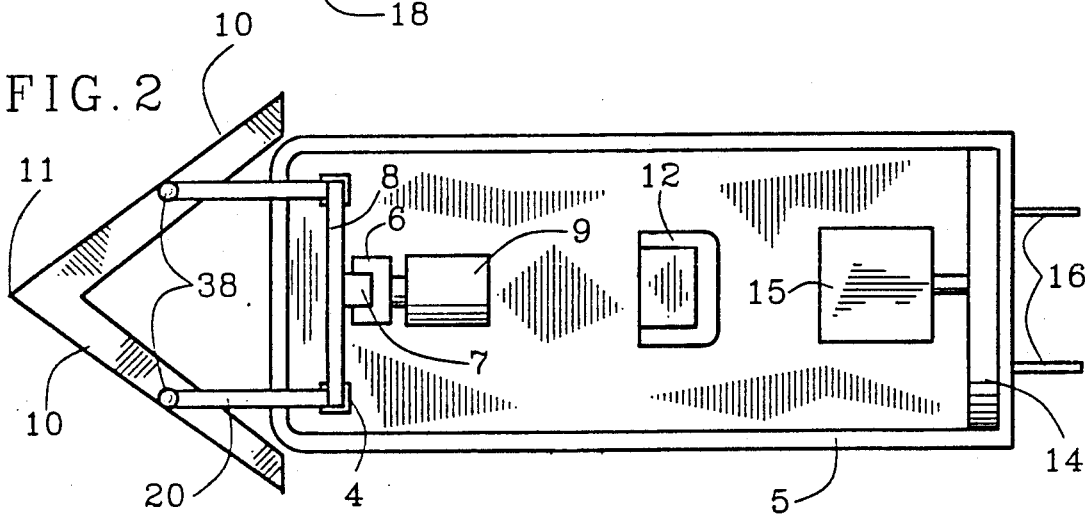
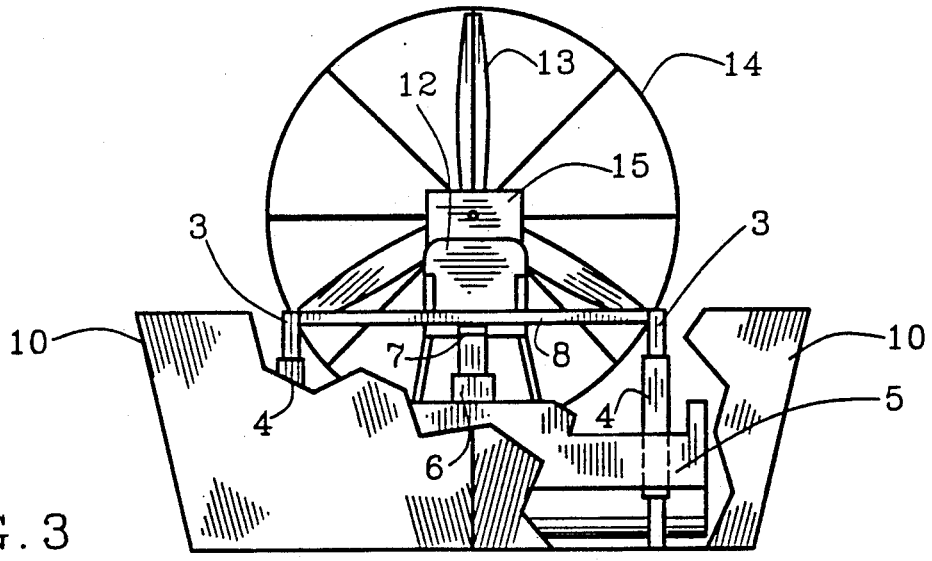
FIG. 3

AIR BOAT SLIME PLOW AND METHODS OF USE

BACKGROUND OF THE INVENTION

This invention is related to air-boats, more particularly, an air-boat plow which can be used to plow drainage waterways in marsh slimes, phosphate slimes, water-plant marshes and other bodies of water that are heavily impregnated with particles or plants.

There are currently no boats for accomplishing this objective. There have been a wide variety of icebreakers that plow through ice, but the function of an icebreaker and its relationship to a marine vessel are different.

SUMMARY OF THE INVENTION

One object of this invention is to provide a plowing mechanism that can be employed to form drainage ditches and waterways in mud-like phosphate or marsh slime deposits.

Another object is to provide a plowing mechanism that can be employed to part thick growths of water plants to form waterways for drainage of lakes for land development.

Another object is to provide a plowing mechanism that can be employed to part thick growths of water plants in bodies of water to form waterways for fishing and hunting access by other air-boats and other types of boats.

Still another object of this invention is to provide a plowing mechanism that can be regulated in depth and width of ditching capacity.

The present invention accomplishes the above and other objectives by providing an air-boat with a hollow suspension member through which a plow attachment member is insertable to contain plowshare members at a front section of the air-boat. there can be a plurality of hollow suspension members and a hoist with mechanical or motorized operation to adjust height and width positioning of the plowshare members. The plowshare members can be V-shaped moldboard surfaces for forming ditches in mud, slime or marsh-bottom deposits. Optionally, the plowshare members can be blades with either sharp, flat or rounded surfaces for parting water plants to form waterways in bodies of water. Methods are provided for forming drain ditches in slime beds and waterways in lakes with thick water-plant growth.

BRIEF DESCRIPTION OF THE DRAWINGS

This invention is described by claims in relation to a description of preferred embodiments illustrated in the following drawings in which:

FIG. 1 is a side view with a plowshare having a V-shaped moldboard surface;

FIG. 2 is a top view of the FIG. 1 embodiment;

FIG. 3 is a partial cutaway front view of the FIG. 1 embodiment;

DESCRIPTION OF THE PREFERRED EMBODIMENTS

Figure 4:
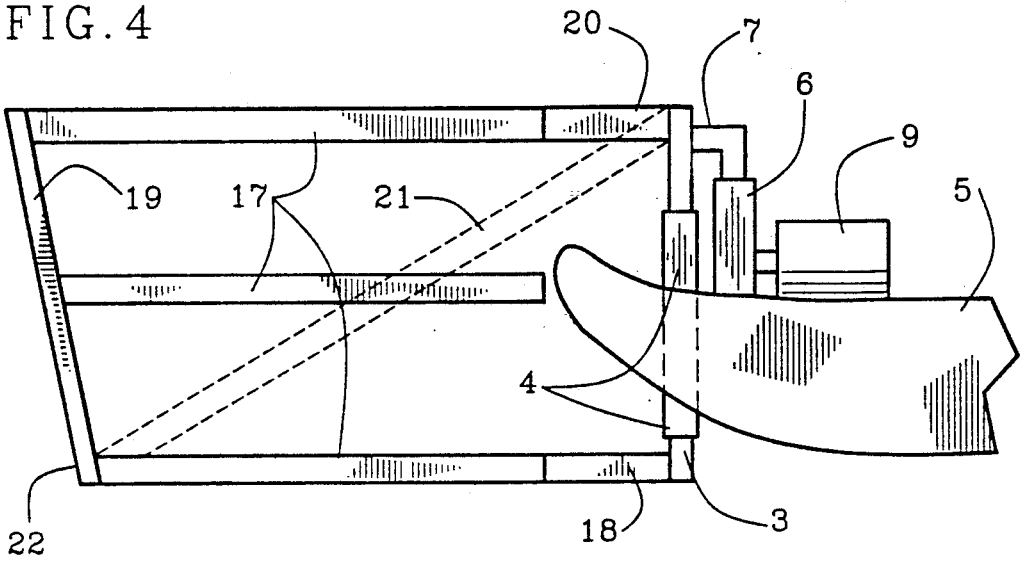
FIG. 4 is a sectional view of the front of an air-boat with a blade-type plowshare for parting water plants.
Figure 5:
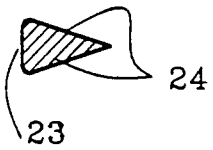
FIG. 5 is a cross-section of a plowshare blade having a flat front for pushing water plants aside and a tapered aft section for minimizing aft drag.
Figure 6:
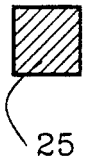
FIG. 6 is a cross-section of a rectangular plowshare blade.

Referring to FIGS. 1-3, a plowshare 1 is attachable to an air-boat 2 by means of plow-attachment members 3 which are extendible in linear-bearing relationship through hollow suspension members 4. the plowshare 1 can be adjusted vertically in relationship to air-boat hull 5 by means of a jack 6 with a lift-arm 7 positionable in lift relationship to a tie-rod 8 extended between plow-attachment members 3 at opposite sides of the air-boat hull 5. The jack 6 can be either a gear-type or hydraulic type, either of which can be hand-operable or operable with hoist motor 9.

The plowshare 1 can be provided with V-shaped plowshare moldboards 10 extended from a plowshare point 11 in optionally swivelable attachment. Unlike moldboards for a moldboard soil plow, the moldboards for this air-boat plow can be symmetrical to form ditches rather than to cut soil from one side and transfer it to the opposite side of the plow. Material for structure of the moldboards is light, rather than the heavy metal used for moldboard plows to turn soil. They can be shaped aluminum plating, fiber-reinforced resin or other light but suitably strong and wear-resistant material. Titanium alloys would be suitable but likely too expensive at current production costs. Moreover, there is not the heavy concentrated work-load of a moldboard for plowing soil.

The air-boat can be provided with a standard raised seat 12, a propeller 13 in a shroud 14 driven by an engine 15 and guided by air rudders 16. Standard air-boats 1 are constructed of light material to minimize draft. Typically, such light boats could not withstand the work moment of a plow. However, it is an object of this invention to overcome this problem by use of the rigid suspension members 4 which transmit work-load to a relatively large section of the air-boat 2 where it can be reinforced with structural material.

Referring to FIG. 4, plowshare blades 17 can be employed optionally in place of moldboards 10 for parting water plants to form waterways in bodies of water. The blades 17 can be attached to a bottom plow rod 18 or to a lead blade 19 which is extended between the bottom plow rod 18 and the top plow rod 20. Alternatively, a plow brace-rod 21 can be attached to the top of plow-attachment members 3 and to a lead-point 22 of opposing plowshare blades 17.

Figure 7:
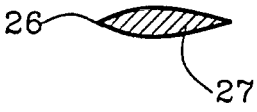
FIG. 7 is a cross-section of a symmetrical hydrofoil plowshare blade with a sharp leading edge to cut water plants and a tapered aft section to minimize aft drag.
Figure 8:
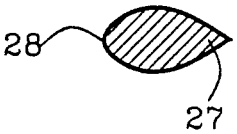
FIG. 8 is a cross-section of a plowshare blade having a rounded leading edge to push water plants aside and a tapered aft section to minimize aft drag.

Referring to FIGS. 5-8, the plowshare blades 17 can be constructed in a variety of different use-conditions. For medium-speed pushing of water plants with a flat blade surface 23, the FIG. 5 form is employed with tapered aft section 24. For slow, heavy-duty plant-parting work, a rectangular form 25 shown in FIG. 6 can be used. For plant-cutting work, a blade 17 with a sharp leading edge 26 and a hydrofoil aft section 27 can be employed as illustrated in FIG. 7. For a combination of relatively-fast pushing movement of plants with high plant-contact surface, a rounded leading edge 28 can be employed in conjunction with a hydrofoil aft section 27 as illustrated in FIG. 8. Either of these blades 17 can be made interchangeable with each other as well as interchangeable with moldboards 10.

Figure 9:
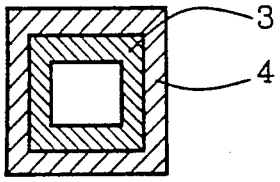
FIG. 9 is a cross-section of a rectangular hollow suspension member and a rectangular plow-attachment member in linear-bearing relationship.
Figure 10:
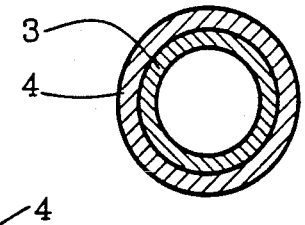
FIG. 10 is a cross-section of a round hollow suspension member and a round plow-attachment member in linear-bearing relationship.
Figure 11:
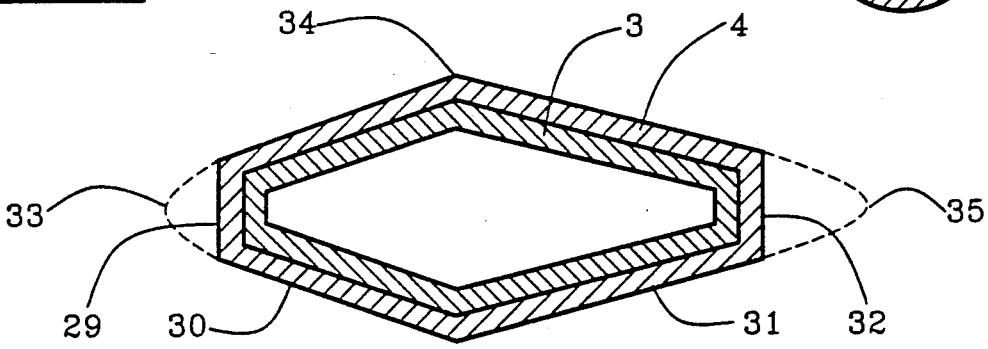
FIG. 11 is a cross-section of a partially or fully hydrofoil-shaped suspension member and a matching plow-attachment member in linear-bearing relationship.
Figure 12:
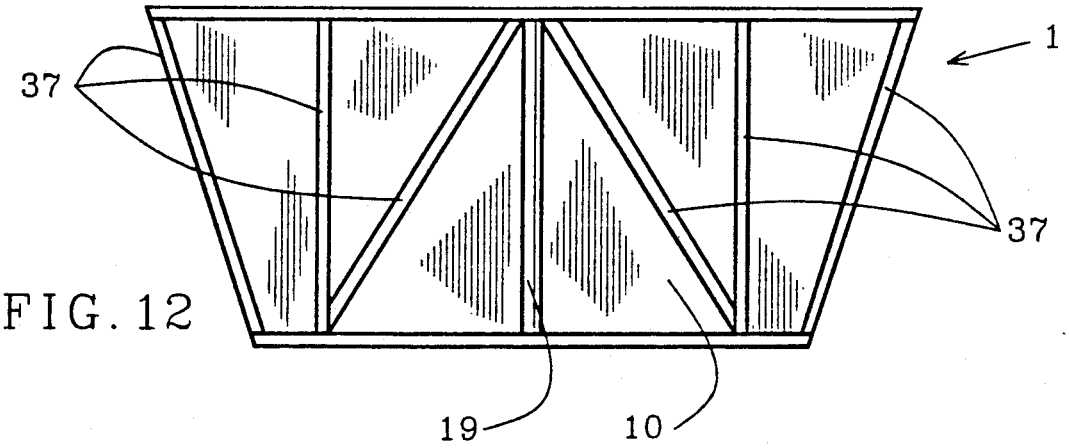
FIG. 12 is a rear view of a plowshare having a V-shaped moldboard surface.

Referring to FIGS. 9 and 10, a plow-attachment member 3 is slideable inside of a hollow suspension member 4 in linear-bearing relationship. The hollow suspension member 4 can be rectangular tubing suitably finished inside and the plow-attachment member 3 can be rectangular tubing or bar stock suitably finished on the outside as illustrated in FIG. 9. As illustrated in FIG. 10, the hollow suspension member 4 can be round tubing suitably finished inside and the plow-attachment member 3 can be round tubing or bar stock suitably finished on the outside.

As illustrated in FIG. II, a hollow suspension member 4 and plow-attachment member 3 can be partially or fully hydrofoil-shaped. For a partial hydrofoil shape, there is a flat front section 29, followed by tapered front sides 30 to a position selectively ahead of center of a cross-sectional length. Then a tapered aft section 31 follows to a flat aft section 32. Full hydrofoil effect can be achieved with a round or pointed front section 33, a curved apex section 34 and a rounded or pointed aft section 35. All surfaces can be blended into suitable curves. The plow-attachment member 3 can be shaped to match the outside of the hollow suspension member 4 or not, depending on use-condition and cost trade-offs.

Referring now to all figures generally and to specific figures as indicated, the partially or fully hydrofoil-shaped members 3 and 4 can be utilized for a double-suspension embodiment with a suspension means at opposite sides of the air-boat 2 as in FIGS. 1-3. However, greatest use for hydro-foil shaped members 3 and 4 may be found in a central suspension member 36 as illustrated in FIG. 14.

Referring to FIGS. 1-3 and 12, a V-shaped moldboard plowshare 10 is shown from the rear with optionally-positionable struts 37 to provide structural integrity without excessive weight of the moldboard surfaces 10. A gimbal 38 shown in FIG. 2 can be employed for swivelable contact of the plowshare 10.

Figure 13:
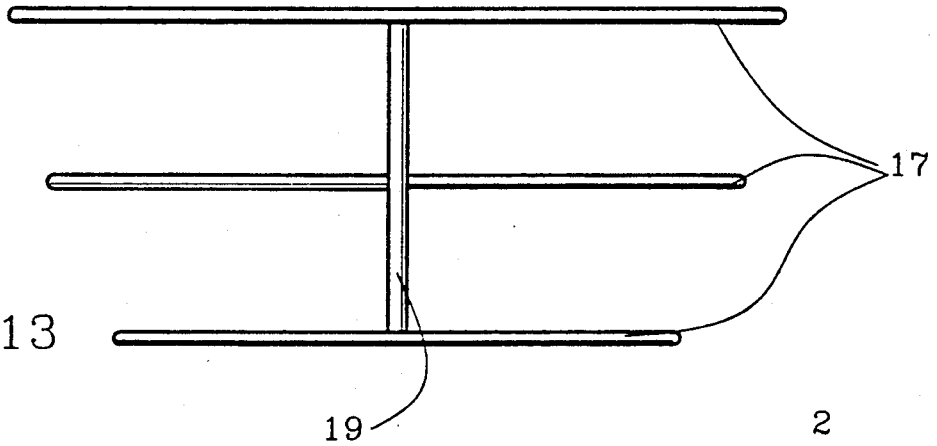
FIG. 13 is a rear view of a bladed plowshare having a plurality of plowshare blades.

Referring to FIGS. 4 and 13, plowshare blades 17 are attachable to a lead blade 19 as seen from a rear view in FIG. 13. Due to small contact surface, hydrofoil reduction of resistance and select resiliency of the blades 17, a single point of contact can be sufficient.

Figure 14:
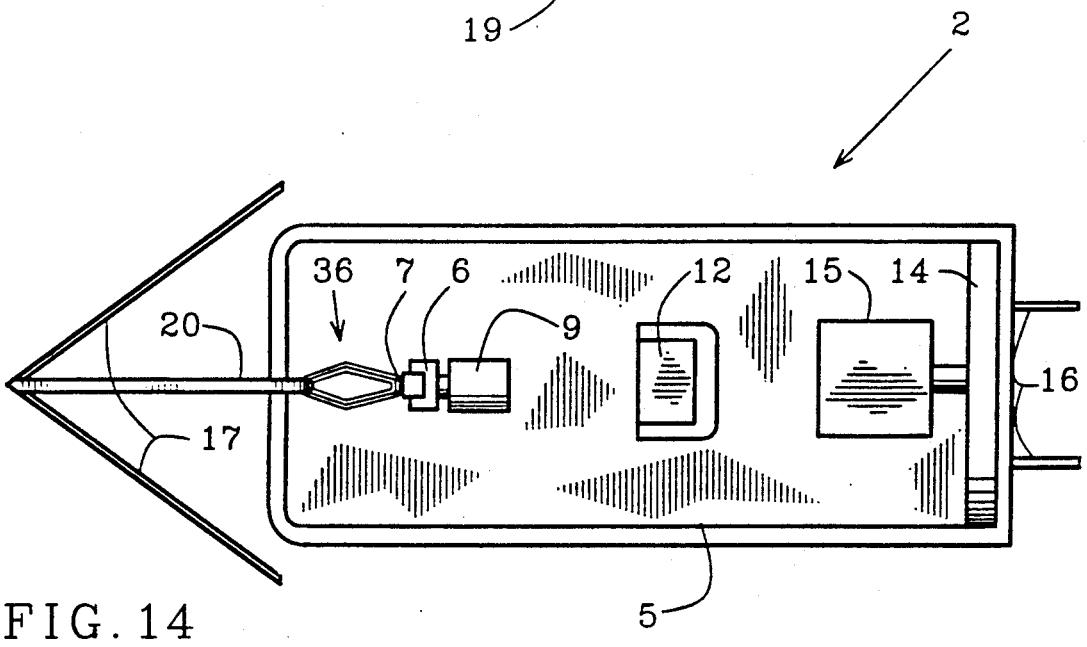
FIG. 14 is a top view of the invention with a bladed plowshare and a single suspension member positioned centrally with a motorized hoist.

Referring to FIGS. 4 and 14, the blades 17 can be attached to a section of contact of a top plow rod 20 and a bottom plow rod 18. Only the top plow rod is visible in the top view of FIG. 14.

Although the description discloses only a few embodiments of the present invention, a variety of forms, modifications, alterations and applications are foreseeable as embodiments of this invention. All such embodiments as described in the appended claims are included in this invention.

Having thus described my invention, I claim:

1. An air-boat plow extensible selectively from a hull of an air-boat in laterally-plowing relationship to forward travel of the air-boat comprising:

a hollow suspension member extended from each side of a front section of the air-boat and having sufficient length and rigidity in relationship to the air-boat to absorb transverse pressures from plowing action of a plow attached to plow-attachment members inside the hollow suspension members;

plow-attachment members extendible through the hollow suspension members; and plow-share members attachable to the plow-attachment members at a bottom section of the air-boat.

2. An air-boat plow according to claim 1 and further comprising:

a hoist positionable on the air-boat and attachable to the plow-attachment members.

3. An air-boat according to claim 2 wherein the hoist is comprised of a mechanical jack with a base on the air-boat and a lift-arm positionable in lift relationship beneath a tie-rod extended between the plow-attachment members.

4. An air-boat plow according to claim 2 wherein the hoist is comprised of a hydraulic jack with a base on the air-boat and a lift-arm positionable in lift relationship beneath a tie-rod extended between the plow-attachment members.

5. An air-boat plow according to claim 2 wherein the hoist is comprised of a motorized jack with a base on the air-boat and a lift-arm positionable in lift relationship beneath a tie-rod extended between the plow-attachment members.

6. An air-boat plow according to claim 1 wherein the plowshare members are surfaces selectively angled outwardly in V-shaped relationship from a front section and upwardly in V-shaped relationship from a bottom section of the air-boat.

7. An air-boat plow according to claim 6 wherein attachment of the plowshare surfaces to the plow-attachment members is swivelable such that angles of upward and outward extension of the plowshare surfaces is variable selectively.

8. An air-boat plow according to claim 1 wherein the plowshare members are blades selectively angled outwardly in V-shaped relationship from a front section of the air-boat.

9. An air-boat plow according to claim 8 wherein attachment of the plowshare blades to the plow-attachment members is swivelable such that angles of outward extension of the plowshare blades is variable selectively.

10. An air-boat plow extensible selectively from a hull of an air-boat in laterally-plowing relationship to forward travel of the air-boat comprising:

a hollow suspension member at a central front section of the air-boat and having sufficient length, width, height and rigidity in relationship to the air-boat to absorb transverse pressures from plowing action of a plow attached to a plow-attachment member inside the hollow suspension member;

a plow-attachment member extendible through the hollow suspension member; and plowshare members attachable to the plow-attachment member at a bottom section of the air-boat.

11. An air-boat plow according to claim 10 wherein an inside periphery of the hollow suspension member is selectively hydrofoil-shaped symmetrically and further comprising:

a plow-attachment member in slideable relationship to the inside periphery of the hollow suspension member.

12. An air-boat plow according to claim 10 and further comprising:

a hoist positionable on the air-boat and attachable to the plow-attachment member.

13. An air-boat plow according to claim 12 wherein the hoist is comprised of a mechanical jack with a base on the air-boat and a lift-arm positionable in lift relationship beneath a jack boss extended from the plow-attachment member.

14. An air-boat plow according to claim 12 wherein the hoist is comprised of a motorized jack with a base on the air-boat and a lift-arm positionable in lift relationship beneath a jack boss extended from the plow-attachment member.

15. An air-boat plow according to claim 12 wherein the hoist is comprised of a hydraulic jack with a base on the air-boat and a lift-arm positionable in lift relationship beneath a jack boss extended from the plow-attachment member.

16. An air-boat plow according to claim 10 wherein the plowshare members are surfaces selectively angled outwardly in V-shaped relationship from a front section and upwardly in V-shaped relationship from a bottom section of the air-boat.

17. An air-boat plow according to claim 16 wherein attachment of the plowshare surfaces to the plow-attachment members is swivelable such that angles of upward and outward extension of the plowshare surfaces is variable selectively.

18. An air-boat according to claim 10 wherein the plowshare members are blades selectively angled outwardly in V-shaped relationship from a front section of the air-boat.

19. An air-boat plow according to claim 18 wherein attachment of the plowshare blades to the plow-attachment members is swivelable such that angles of outward extension of the plowshare blades is variable selectively.

20. An air-boat plow according to claim 18 wherein edges of the plowshare blades are selectively sharp to provide a cutting edge for cutting plants and other objects.

21. An air-boat plow according to claim 18 wherein edges of the plowshare blades are selectively flat to push plants and other objects outward laterally while allowing water to pass over surfaces of the plowshare blades.

* * * * *